US005338165A

United States Patent [19]

Brockner et al.

[11] Patent Number: 5,338,165

[45] Date of Patent: Aug. 16, 1994

[54] AUTOMOTIVE FUEL PUMP WITH MODULAR PUMP HOUSING

[75] Inventors: Henry W. Brockner, Ann Arbor; Robert J. Mohan, Canton Township, Wayne County; Richard Lassen, Pontiac, all of Mich.

[73] Assignee: Ford Motor Company, Dearborn, Mich.

[21] Appl. No.: 797,571

[22] Filed: Nov. 25, 1991

[51] Int. Cl.[5] ..... F04B 35/04

[52] U.S. Cl. ..... 417/423.1; 417/423.14; 417/366; 415/55.1

[58] Field of Search ..... 417/366, 410, 423.1, 417/423.14, 423.8; 415/55.1

[56] References Cited

U.S. PATENT DOCUMENTS

| | | | |
|---|---|---|---|
| 2,283,844 | 5/1942 | Brady | 415/55.1 |
| 4,403,910 | 9/1983 | Watanabe et al. | 415/53 T |
| 4,445,820 | 5/1984 | Hayashi et al. | 415/55.1 |
| 4,445,821 | 5/1984 | Watanabe et al. | 417/366 |
| 4,451,213 | 5/1984 | Takei et al. | 417/366 |
| 4,591,311 | 5/1986 | Matsuda et al. | 417/366 |
| 4,726,746 | 2/1988 | Takada et al. | 417/366 |
| 4,854,830 | 8/1989 | Kozawa et al. | 417/365 |
| 4,948,344 | 8/1990 | Cygnor | 415/55.1 |
| 5,011,367 | 4/1991 | Yoshida et al. | 415/55.1 |
| 5,110,265 | 5/1992 | Kato et al. | 417/366 |
| 5,131,822 | 7/1992 | Yamamoto et al. | 417/366 |
| 5,221,179 | 6/1993 | Ikegami et al. | 415/55.1 |
| 5,265,997 | 11/1993 | Tuckey | 415/55.1 |

*Primary Examiner*—Richard A. Bertsch
*Assistant Examiner*—Peter Korytnyk
*Attorney, Agent, or Firm*—Jerome R. Drouillard; Roger L. May

[57] ABSTRACT

A modular automotive fuel pump includes lower and upper housings, a motor, a rotary pumping element, and a combination clearance land and flow guide which determines the axial clearance between the pump impeller and the pump housing.

7 Claims, 2 Drawing Sheets

AUTOMOTIVE FUEL PUMP WITH MODULAR PUMP HOUSING

FIELD OF THE INVENTION

The present inventive concept relates to a modular automotive fuel pump, as well as to a method for manufacturing same.

BACKGROUND OF THE INVENTION

Automotive fuel pumps using rotary pumping elements, in general, and regenerative turbines in particular, have been used for many years. Such pumps typically have two-piece pump housings within which the impeller or turbine is rotated by an electric motor. Examples of such pumps are shown in U.S. Pat. No. 4,403,910 and U.S. Pat. No. 4,445,821, both to Watanabe et al., and U.S. Pat. No. 4,451,213 to Takei et al. The pump housings illustrated in these patents are typical of prior art devices inasmuch as the housings are generally comprised of two main parts, with the impeller operating in a chamber defined by the two pieces of the pump housing.

Those skilled in the art will appreciate that the performance of rotary pumps in general, and regenerative turbine pumps in particular is greatly dependent upon the ability to operate the pump with minimum internal leakage. Specifically, if the pumped fluid, in this case motor fuel, is permitted to flow radially across the sides of the impeller, the performance of the pump will be greatly degraded. To avoid such degradation, the clearances between the impeller and the pump housing must be exceedingly small. This requirement may cause problems during manufacturing with the illustrated and conventional prior art pump housings because it is not an easy task to repeatably build fine toleranced parts required in the pump housing and then match such parts to the impeller. This problem stems from the fact that the tolerances applied to individual parts may stack up to produce an unacceptable result in the assembled pump. If, on one hand, the clearances between the impeller and the pump housing are too great, the performance of the pump will be inadequate. If, on the other hand, the tolerances are too little, the pump may not work at all, or the motor may fail at an early age due to excessive drag imposed by the pump assembly.

It is an object of the present invention to provide an automotive fuel pump with a modular pump housing which offers superior pump performance.

It is another object of the present invention to provide an automotive fuel pump which may be manufactured with ease using conventional manufacturing techniques.

It is yet another object of the present invention to provide a method for manufacturing high performance automotive fuel pumps in an economical manner.

It is yet another object of the present invention to provide a pump having a structure which is manufacturable using more robust processes than those employable with prior art units. Specifically, prior art pump housings are generally not compatible with the surface finishing process known as "lapping" because lapping is best used in connection with flat surfaces, and not with dished or multi-planar surfaces. A pump according to the present invention uses three major modules which may all be finished by lapping on large, flat lapping machines, at lower cost.

Other objects, features, and advantages of the present invention will become apparent to the reader of this specification.

SUMMARY OF THE INVENTION

A modular automotive fuel pump includes a lower housing having a first end with a central, annular, planar sealing surface and an outer mounting annulus which is coplanar with the central sealing surface. The lower housing also includes a second end with a fuel inlet. The pump further includes an upper housing having a first end with a central, annular, planar sealing surface and an outer mounting annulus which is coplanar with the central sealing surface. The upper housing further includes a second end with a fuel outlet. The fuel pump also includes a motor having a shaft extending therefrom upon which a rotary pumping element, mounted on the motor shaft between the lower and upper housings, rotates. The rotary pumping element preferably comprises a bladed, two-sided disk having a circular planar sealing surface extending radially outward from the center on each side of the disk.

A pump according to the present invention also includes a combination clearance land and flow guide comprising an annular ring positioned between the lower and upper pump housings and having a separate annular face in contact with the mounting annulus on the first end of each housing. Accordingly, the combination land and flow guide establishes axial clearance spaces between the sealing surfaces of the disk and the corresponding sealing surfaces of the lower and upper housings. The axial clearance spaces have the form of truncated cylinders. The combination land and guide has a radially inward surface defining a circumferential wall about the pumping element. The axial thickness of the combination land and guide is only slightly greater than the axial thickness of the rotary pumping element disk so that the sealing surfaces of the disk and the corresponding sealing surfaces of the lower and upper housings will cooperate to control the leakage flow of fuel through the clearance spaces.

The upper and lower housings are further defined in that each has an annular channel chamber extending from the fuel inlet or outlet, as the case may be, about 315° of rotation.

According to another aspect of the present invention, a method for manufacturing a modular automotive fuel pump characterized by a motor driven impeller housed between lower and upper pump housings, with the impeller having sealing surfaces cooperating with associated sealing surfaces on the housings, comprises the steps of fabricating the lower and upper pump housings with each housing comprising a first axially outward end and a second axially inward end with the second ends being generally planar and having sealing surfaces adapted to seal with the impeller. The present method also includes fabricating a population of combination clearance land and flow guide components, with each component comprising a generally annular ring adapted for positioning between the lower and upper housings and having a separate annular face for contacting the second end of each lower and upper housing. The present method also includes fabricating a population of impeller components, with each comprising a bladed, two-sided disk having a planar sealing surface extending radially outwardly from the center of each side of the disk. Thereafter, according to the present invention, an insert module may be built by selecting a combination land and guide component and an impeller component from each component's respective population, such that the actual axial length of the combination land and guide component exceeds the axial length of the impeller component by an amount sufficient to establish a desired operating clearance between the impeller and the second ends of the lower and upper pump housings. Finally, the present method concludes with assembling of the insert module between the lower and upper pump housings.

DETAILED DESCRIPTION OF THE PREFERRED EMBODIMENTS

Figure 1:
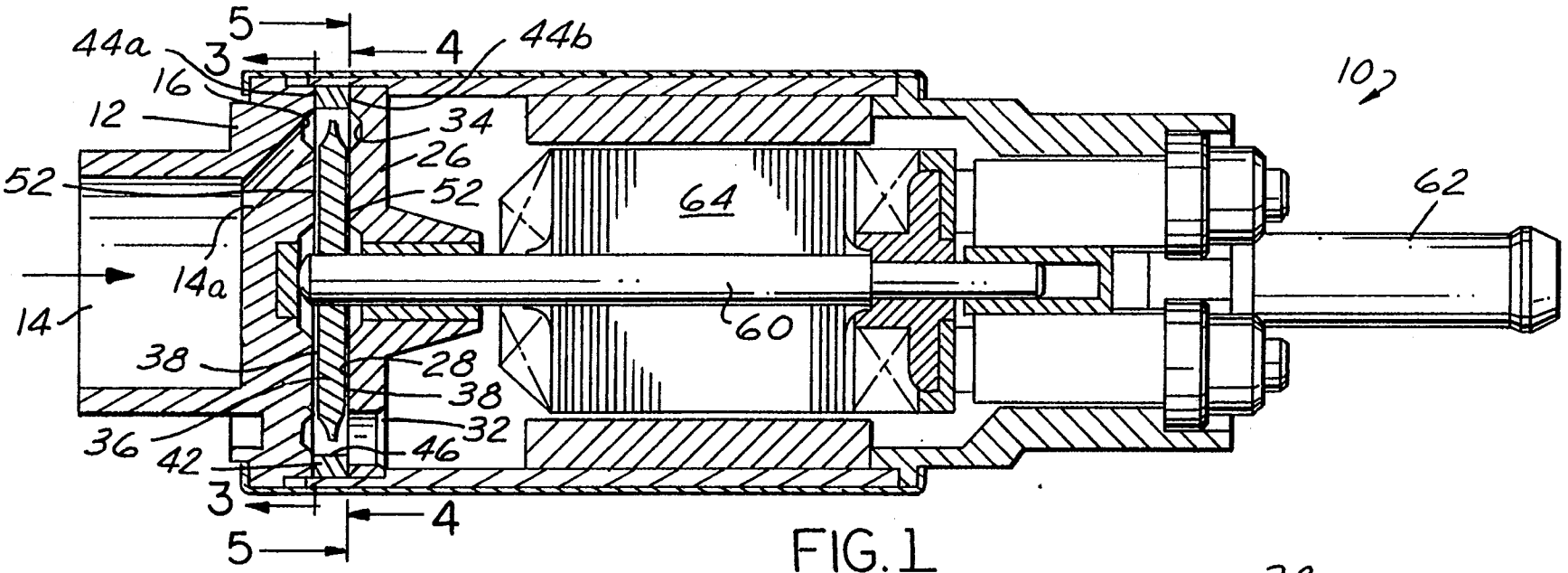
FIG. 1 is a sectional view of a fuel pump according to the present invention.

As shown in FIG. 1, an automotive fuel pump with modular pump housing according to the present invention is an electric motor driven pump intended to move fuel from an inlet, 14, to a discharge tube, 62. To accomplish this end, an impeller, 36, is mounted on the shaft, 60, of a motor, 64, such that impeller 36 is positioned between lower pump housing 12 and upper pump housing 26.

Figure 3:
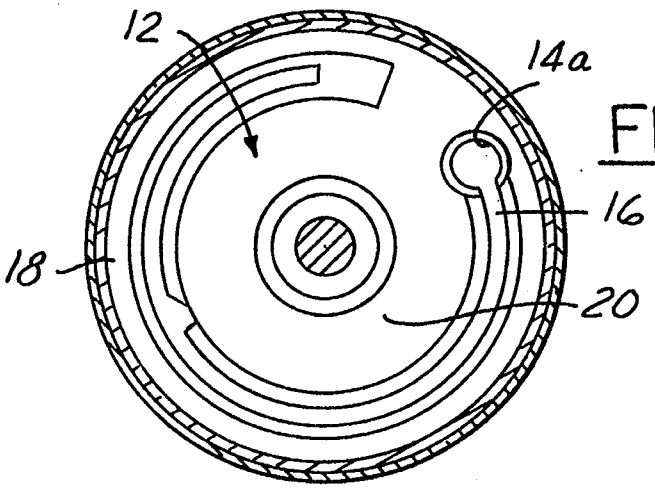
FIG. 3 is a sectional view of the pump of FIG. 1 taken, along the line 3—3 of FIG. 1.
Figure 2:
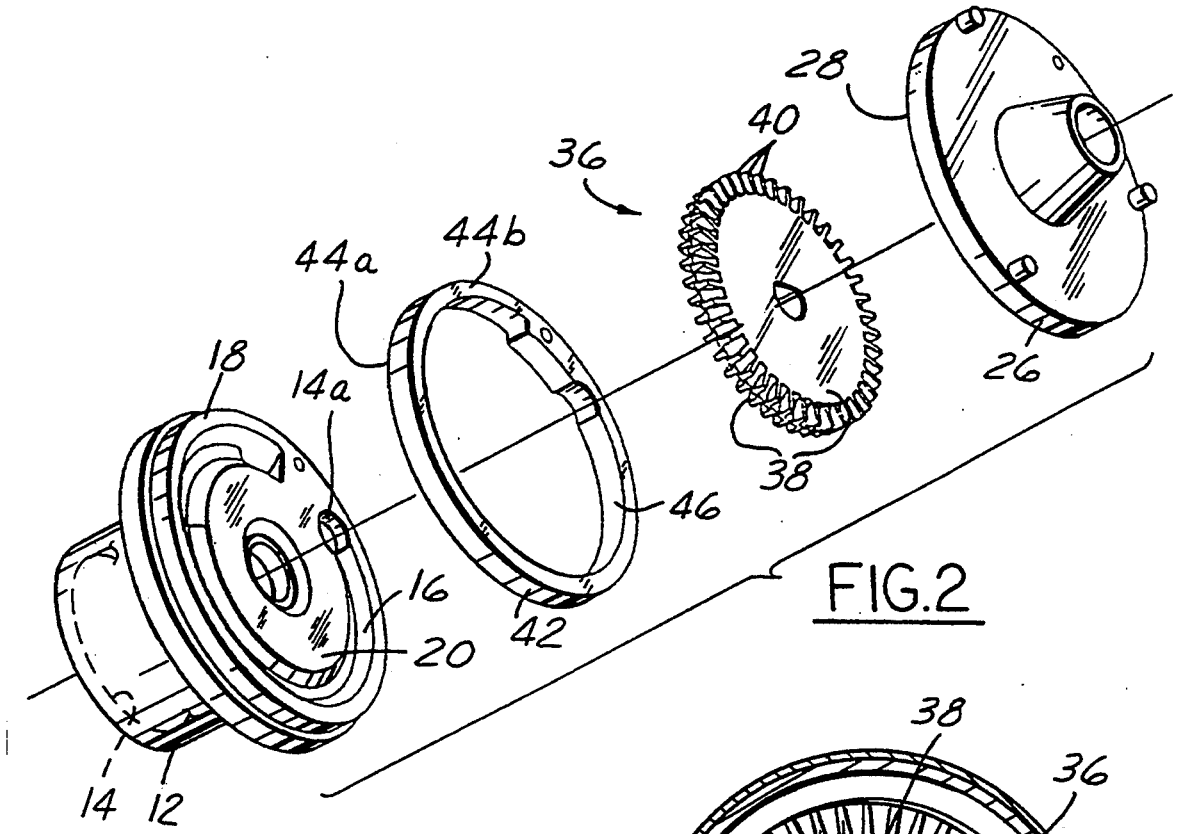
FIG. 2 is an exploded perspective view of the pumping section of a fuel pump according to the present invention.

Lower pump housing 12 includes inlet 14 and an annular channel, 16, which is best viewed in FIGS. 2 and 3. Channel 16 is connected with inlet 14 by means of a passage, 14*a*. Channel 16 extends from passage 14*a* to a location about 315 degrees of rotation from the passage.

Fuel entering inlet 14 is picked up by impeller 36 and moved to outlet 32 in upper housing 26. Note that upper housing 26 has an annular channel, 34, which cooperates with annular channel 16 and impeller 36 to allow pump 10 to operate as a regenerative turbine pump in a manner known to those skilled in the art. As with channel 16, channel 34 extends approximately 315 degrees of rotation. Channels 16 and 34 may extend from approximately 250 to 320 degrees of rotation, depending upon the characteristics needed for a particular pump according to the present invention.

Figure 4:
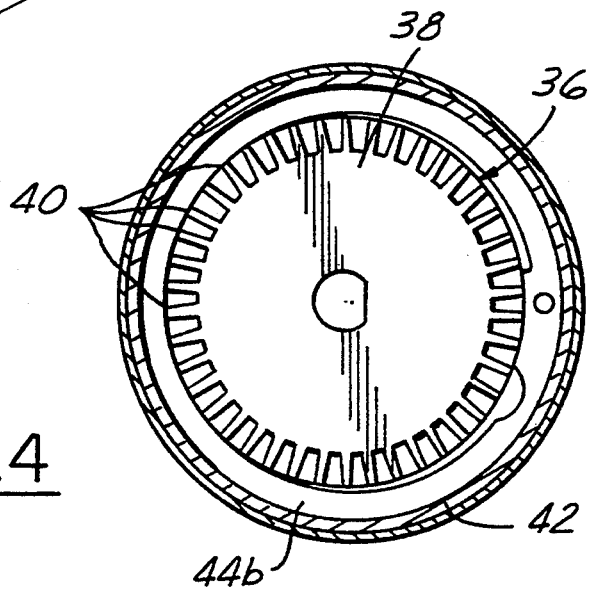
FIG. 4 is a sectional view of the pump of FIG. 1, taken along the line 4—4 of FIG. 1.

Further details of the construction of impeller 36, are shown in FIGS. 2 and 4. The impeller, which comprises a rotary pumping element, and which is mounted on motor shaft 60 so as to turn therewith, is a two-sided disk having a plurality of blades 40 about its outer periphery. The disk has a circular, planar sealing surface, 38, extending radially outwardly from the center of each side of the disk. These sealing surfaces, together with central annular sealing surface 20, formed on the axially inward end of lower pump housing 12 and sealing surface 28, formed on the axially inward end of upper pump housing 26, cooperate to prevent undesirable radial flow of the pumped fuel from the pump chamber formed by channels 16 and 34 and clearance land and flow guide 42 in a manner so as to short circuit the pumping action.

FIG. 1 illustrates axial clearance spaces 52, which extend on either side of impeller 36. The present invention is concerned with maintaining such spaces within optimal specifications, so as to produce acceptable pump performance and durability, without the need for costly and difficult machining techniques necessitated by prior art pump constructions. An example of a prior art pump having less than optimal construction in terms of machinability and manufacturability is shown in U.S. Pat. No. 4,854,830, in which a twin rotor pump, having a type of spacer ring interposed between the upper and lower pump housings and an intermediate housing, has running clearances which are set by obliquely cutting the side surfaces of either the rotors or pump housings. The present invention obviates the need for such machining operations.

Axial clearance spaces 52 are in the form of truncated cylinders defined by the sealing surfaces on the lower and upper pump housings and on the impeller (in this case, sealing surfaces 38 on the impeller, 28 on the upper pump housing, and 20 on the lower pump housing). The sealing surfaces must cooperate to prevent excessive flow through clearance spaces 52 because such flow may degrade the performance of the pump unacceptably. If the sealing surfaces are properly spaced, they will cooperate to control the flow through the spaces so as to produce an acceptable pump performance.

Details of construction of clearance land and flow guide 42 are shown in FIG. 1 and FIG. 2. The land and flow guide 42 has annular contact faces 44*a* and *b*, which contact lower pump housing 12 and upper pump housing 26, respectively. Radially inward surface 46 cooperates with channel 16 and channel 34 to define the pumping chamber of the present pump.

Figure 5:
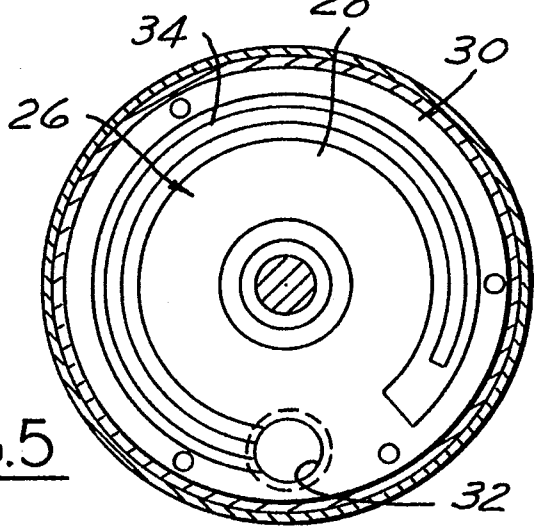
FIG. 5 is a sectional view of the pump of FIG. 1 taken along the line 5—5 of FIG. 1.

As shown in FIGS. 1 and 2, clearance land and flow guide 42 contacts lower housing 12 in the area of mounting annulus 18 (FIG. 3) and upper housing 26 in the area of mounting annulus 30 (FIG. 5). Thus, the axial thickness of clearance land and flow guide 42 determines the axial separation between sealing surfaces 20 and 28 of the lower and upper pump housings, respectively. As a result, the axial thickness of clearance and flow guide 42 may be used to set the operating clearance spaces 52 between impeller 36 and the corresponding sealing surfaces of the lower and upper housings. This setting may be accomplished in the following manner. Starting with fabricated lower and upper pump housings with each having the attributes described herein, a population of clearance land and flow guide components 42 may be created using fabrication techniques known to those skilled in the art and suggested by this disclosure. Such techniques include, without limitation, casting, molding, machining, and others. In any event the surfaces 44*a* and *b*, and for that matter, sealing surfaces 20, 28, and 38 must be treated by lapping or by some other suitable process to achieve a fine surface finish. Thereafter, the populations of clearance land and flow guide components 42 and impeller components 36 may be sorted and matched so that the axial length of each impeller component is slightly exceeded by the axial length of the matched combination land and guide component for each particular pump. It has been determined that a total axial length difference on the order of 0.02 mm will produce desirable pump performance. A modular pump constructed according to the present invention is advantageous because the individual parts such as the upper and lower housings and the combination land and flow guide may be manufactured independently, without undue concern for tolerance stack-up problems, because the running clearances are set when the insert module including land and flow guide 42 and impeller 36 is assembled.

Building a fuel pump according to the prescription herein of first fabricating the lower and upper pump housings and then fabricating assorted populations of clearance land and flow guide and impeller components enables the clearances between the pump housing and the impeller to be set independently without resort to extremely tight tolerance manufacturing operations for either the upper or lower pump housing elements. As a result, a modular pump according to the present invention offers greater ease of manufacturing, including ease of machining, because the critical pump components may all be finished by economical flat surface grinding, or lapping, or by other conventional surface finishing techniques known to those skilled in the art and suggested by this disclosure. Note in this regard that the size of the pump channel defined by channel 16, channel 34, and clearance land and flow guide 42, may be altered by substituting appropriately sized components 42 and impeller 36.

Those skilled in the art will appreciate in view of this disclosure that modifications to the invention described herein may be made without departing from the scope of the invention as defined by the appended claims.

We claim:

1. A modular automotive fuel pump, comprising:

a lower housing having a first end with a central, annular, planar sealing surface, an outer mounting annulus which is coplanar with the central sealing surface, and a second end with a fuel inlet;

an upper housing having a first end with a central, annular, planar sealing surface, an outer mounting annulus which is coplanar with the central sealing surface, and second end with a fuel outlet;

a motor having a shaft extending therefrom;

a rotary pumping element, mounted on said motor shaft between said lower and upper housings, comprising a bladed, two-sided disk having a circular, planar sealing surface extending radially outwardly from the center on each side of said disk, with said circular sealing surfaces of the rotary pumping element being parallel to each other and parallel to said annular sealing surfaces of the lower and upper housings; and a combination clearance land and flow guide comprising an annular ring positioned between said lower and upper housings and having a separate annular face in contact with the mounting annulus on the first end of each housing, so as to establish axial clearance spaces between the sealing surfaces of the disk and the corresponding sealing surfaces of the lower and upper housings, with said combination land and guide having a radially inward surface defining a circumferential wall about said pumping element, and with the axial thickness of said combination land and guide being only slightly greater than the axial thickness of said disk, such that the sealing surfaces of the disk and the corresponding sealing surfaces of the lower and upper housings will cooperate to control the flow of fuel through the axial clearance spaces.

2. A pump according to claim 1, wherein said rotary pumping element comprises a regenerative turbine impeller.

3. A pump according to claim 1, wherein each clearance space extending between a sealing surface of the disk and a sealing surface of the pump housing comprises a truncated cylindrical space.

4. A pump according to claim 1, wherein the sealing surface and mounting annulus of said lower housing are generally defined by an annular channel chamber extending from said fuel inlet to a location about 315 degrees of rotation from the inlet.

5. A pump according to claim 1, wherein the sealing surface and mounting annulus of said upper housing are generally defined by an annular channel chamber extending from said fuel outlet to a location about 315 degrees of rotation from the outlet.

6. A pump according to claim 1, wherein said sealing surfaces have a lapped finish.

7. A method for manufacturing a modular automotive fuel pump characterized by a motor driven impeller housed between lower and upper pump housings and having sealing surfaces cooperating with associated sealing surfaces on said housings, comprising the steps of:

fabricating the lower and upper pump housings, with each housing comprising a first axially outward end and a second, axially inward end, with said second ends being generally planar and having annular sealing surfaces adapted to seal with said impeller;

fabricating a population of combination clearance land and flow guide components, with each component comprising a generally annular ring adapted for positioning between the lower and upper housings and having a separate annular face for contacting the second end of each lower and upper housing;

fabricating a population of impeller components, with each comprising a bladed, two-sided disk having a circular, planar sealing surface extending radially outwardly from the center on each side of said disk, both sealing surfaces being parallel to the other;

building an insert module by selecting a combination land and guide component and an impeller component from each component's respective population such that the axial length of the combination land and guide component exceeds the axial length of the impeller component by an amount sufficient to establish a desired operating clearance between the impeller and the second ends of the lower and upper pump housings; and assembling said insert module between said lower and upper housings, with said circular sealing surfaces of the impeller being parallel to said annular sealing surfaces of the lower and upper housings.

* * * * *